US007229304B2

(12) United States Patent
Annecke

(10) Patent No.: US 7,229,304 B2
(45) Date of Patent: Jun. 12, 2007

(54) CONNECTOR FOR PYROTECHNIC APPLICATIONS

(75) Inventor: Alfred Annecke, Heilbronn (DE)

(73) Assignee: Amphenol-Tuchel Electronics GmbH, Heibronn (DE)

( * ) Notice: Subject to any disclaimer, the term of this patent is extended or adjusted under 35 U.S.C. 154(b) by 0 days.

(21) Appl. No.: 11/498,085

(22) Filed: Aug. 3, 2006

(65) Prior Publication Data

US 2007/0037428 A1 Feb. 15, 2007

(30) Foreign Application Priority Data

Aug. 12, 2005 (EP) ..... 05017611

(51) Int. Cl.
*H01R 13/52* (2006.01)

(52) U.S. Cl. ..... 439/281; 439/352

(58) Field of Classification Search ..... 439/352, 439/357, 358, 188, 281, 732
See application file for complete search history.

(56) References Cited

U.S. PATENT DOCUMENTS 5,529,512 A * 6/1996 Mlyniec ..... 439/352
5,863,214 A * 1/1999 Hanak ..... 439/352
6,902,438 B2 * 6/2005 Tsuyama ..... 439/694

FOREIGN PATENT DOCUMENTS

DE 44 26 812 A1 2/1996
DE 295 21 491 U1 7/1997

OTHER PUBLICATIONS

European Patent Office, European Search Report issued Mar. 14, 2007, with respect to European Patent Application No. 05017611.4.

* cited by examiner

*Primary Examiner*—Tho D. Ta
(74) *Attorney, Agent, or Firm*—Blank Rome LLP

(57) ABSTRACT

A connector including a plurality of receptacles located in a housing, and a primary interlock for engaging a contact plug pluggable into the receptacles. A secondary interlock is moveable between a full catch position and a half-catch position with respect to the housing. A seal is provided for sealing the secondary interlock relative to the housing. The secondary interlock moves relative to the seal while maintaining a seal from the half-catch position into the full catch position of the secondary interlock.

16 Claims, 9 Drawing Sheets

CONNECTOR FOR PYROTECHNIC APPLICATIONS

RELATED APPLICATION

This application claims priority to European Patent Application No. EP 05 017 611.4, filed on Aug. 12, 2005, the subject matter of which is herein incorporated by reference in its entirety.

FIELD OF THE INVENTION

The invention relates to a connector for pyrotechnic applications in motor vehicles, that may comprise jacks located in a housing, a primary interlock for fixing a contact plug which may be plugged into the jacks, and a secondary interlock.

BACKGROUND OF THE INVENTION

The demands on durability and especially reliability of connectors for pyrotechnic applications are often extremely high. Improvements to the reliability of the current connectors available in the industry often come at the expense of functionality, not least due to the small dimensions.

SUMMARY OF THE INVENTION

The object of the invention is to devise a connector which is reliable and substantially resistant to ambient effects while maintaining the functionality of a secondary interlock.

Based on the configuration of the connector of the present invention, a contact plug interior can be protected against splashing water and/or water jets, with simultaneous preservation of the functionality of the secondary interlock. In order to ensure sealing, in an embodiment of the present invention, there is a seal which is arranged such that relative displacement of the secondary interlock relative to the seal while maintaining the sealing function may be possible in order to shift the secondary interlock from the outside of the connector from a half-catch position into a full catch position. The configuration of the connector in an embodiment of the present invention makes it possible to deliver the connector premounted and with a half-locked secondary interlock. In this half-catch position, the seal executes its sealing function. The sealing function is not lost even during displacement of the secondary interlock into the full catch position in an embodiment of the present invention.

In one embodiment of the invention, it is preferable that the secondary interlock has an external, preferably at least approximately circular cylindrical, peripheral sealing section. A uniform tension distribution and thus an optimum sealing action may be achieved by the geometry of the secondary interlock which may be circular in cross section.

In order to ensure optimum sealing with a simultaneous displacement capacity of the secondary interlock, it is preferable that the seal may contain a sealing bead which runs radially inside along the periphery and which adjoins the sealing section of the secondary interlock. Preferably, the internal cross section of the sealing bead may be made complementary in shape to the outside contour of the seal section. For a seal section with a circular cross section, the cross section of the seal bead may be accordingly likewise circular. In this connection, the inside diameter of the sealing bead in the unmounted state should be smaller than the outside diameter of the sealing section.

In order to prevent water from splashing through the secondary interlock itself into the interior of the connector, according to one preferable configuration of the invention, it is provided that the area of the secondary interlock surrounded by the sealing section is closed. This area may be made trough-shaped and may be movable in order to move the secondary interlock from the unengaged position into its full catch position.

In order to achieve an optimum seal of the secondary interlock relative to the interior of the connector, in an embodiment of the present invention, the secondary interlock may comprise an axial stop preferably with the shape of an annular shoulder for contact with the seal in the full catch position. In the full catch position, the seal thus adjoins the secondary interlock not only in the radial, but also in the axial direction; this leads to improved sealing results.

In another embodiment of the invention, the seal geometry of the secondary interlock seal may be integrated into the housing seal. In other words, the seal of the secondary interlock may be made in one piece with the housing seal. In this way a separate component may be abandoned when the seal of the secondary interlock and the housing seal are produced by extrusion coating of the connector with a permanent elastic material, polyurethane, for example, in a common production step. In this common extrusion coating process of the housing, the subsequent seal for the secondary interlock (sealing bead) may be relieved in the extrusion coating tool by the punch. The openings in the housing necessary for the secondary interlock may be closed by the punch, then the secondary interlock seal may be molded on. This seal then rests against the sealing section of the secondary interlock which can then be mounted with pretensioning.

According to one embodiment of the present invention, it is provided that the connector has a trunk area for holding a contact plug and that in the trunk area there may be a peripheral seal for the contact plug. By using this seal for the contact plug in the trunk area, for example, contact may be made with igniters which may have a standard insulating ring with a short circuit bridge and polarization area. In one embodiment of the present invention, the correct position of the seal may be scanned by way of the short circuit bridge of the connector. To do this, it may simply be electrically measured whether the contacts are short-circuited or not. After the secondary interlock is moved into its full catch position, the contacts are no longer short-circuited. Since the secondary interlock may be pushed into its full catch position only with the contract plug inserted, ascertaining that there is no short circuit may be used as an indicator for an inserted and sealed contact plug.

In order to make it difficult for the sealing mass to penetrate into the housing in the extrusion coating process, it is preferable that the housing comprises two lockable components between which there may be a peripheral tongue-in-groove connection. That protects the interior of the plug against the highly pressurized sealing mass.

BRIEF DESCRIPTION OF THE DRAWINGS

The invention is detailed below using an exemplary embodiment of the present invention shown in the drawings.

FIG. 9 shows a second housing part in accordance with an embodiment of the present invention.

DETAILED DESCRIPTION OF THE EXEMPLARY EMBODIMENTS

Figure 1:
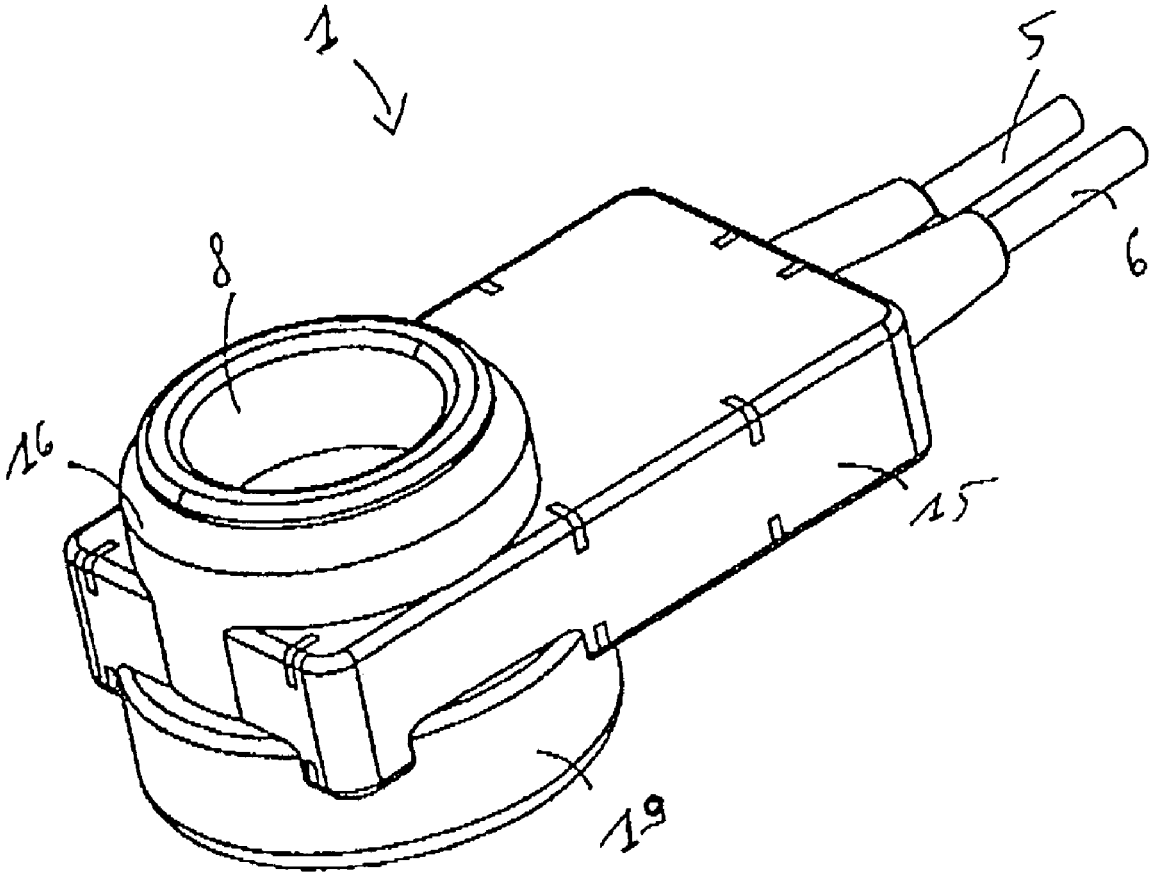
FIG. 1 shows a perspective view of a connector according to an embodiment of the present invention with a secondary interlock in the full catch position.
Figure 3:
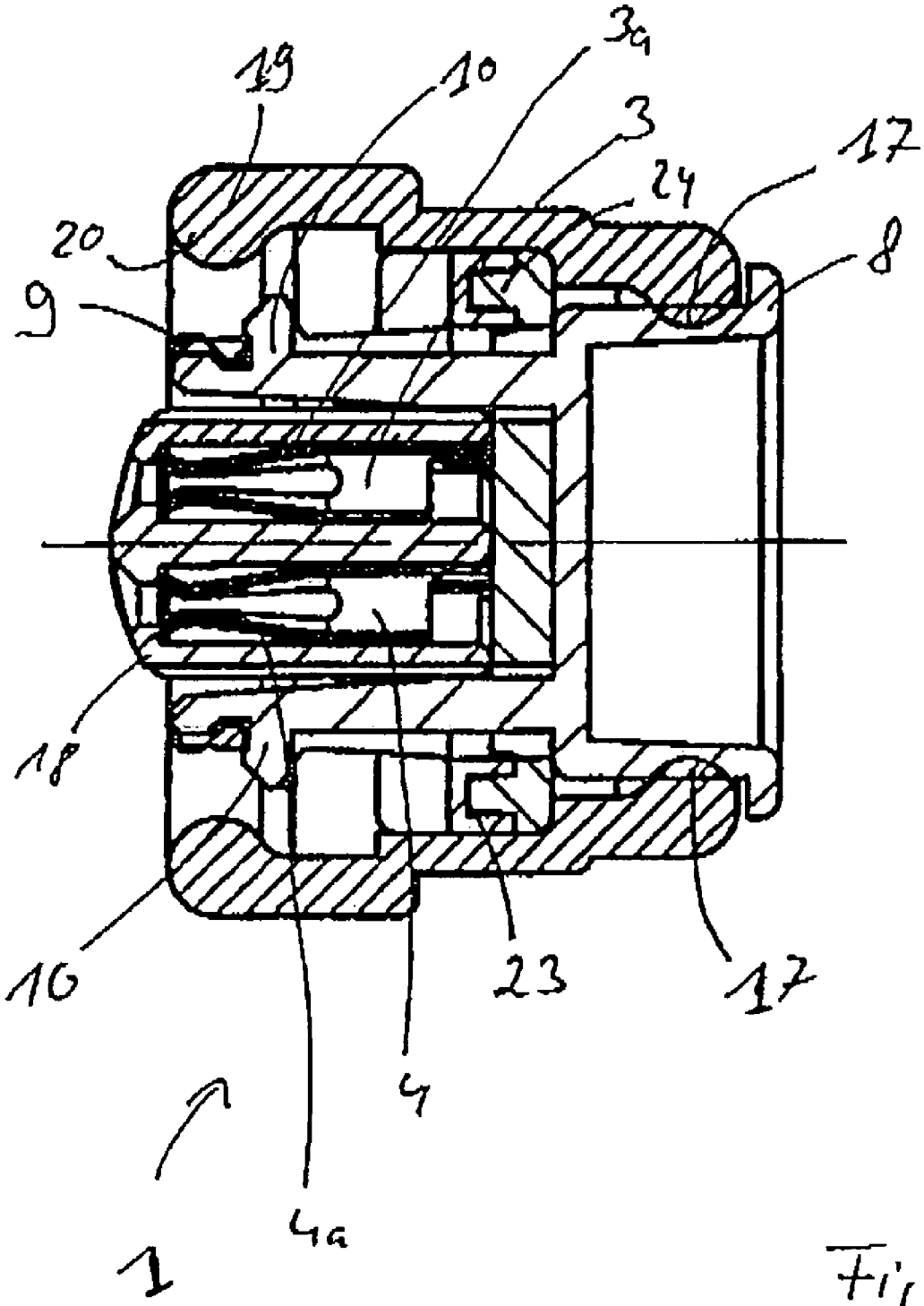
FIG. 3 shows an end elevational view in section of the connector as shown in FIG. 1.
Figure 4:
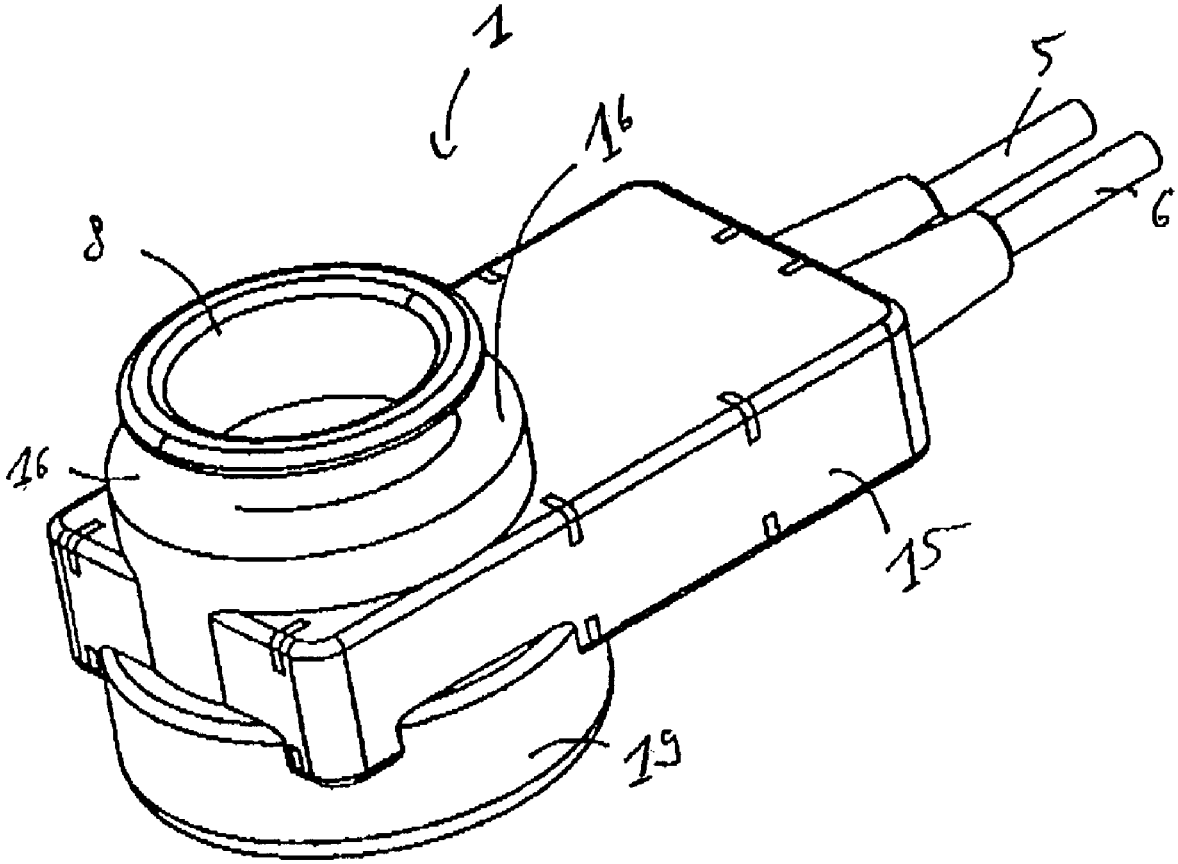
FIG. 4 shows a perspective view of the connector according to an embodiment of the invention with a secondary interlock in the half-catch position.

The figures show a connector 1 for airbags. The connector 1 may comprise a housing 2 in which there may be two receptacles or jacks 3, 4. Partially gold-plated, resilient contracts 3*a*, 4*a* may be placed in the jacks. Each contact 3*a*, 4*a* may be connected in an electrically conductive manner to an electric wire 5, 6 which leads into the housing. The jacks 3, 4 with the contacts 3*a*, 4*a* may be used to hold a contact plug which is not shown. The connector 1 may be provided with a secondary interlock 8. The secondary interlock 8 may be pushed in a straight line into the housing 2 between the half-catch position shown in FIGS. 4 to 6 into the full catch position shown in FIGS. 1 to 3. This safeguards the primary interlock 9 for fixing the plug contact (not shown).

Figure 7:
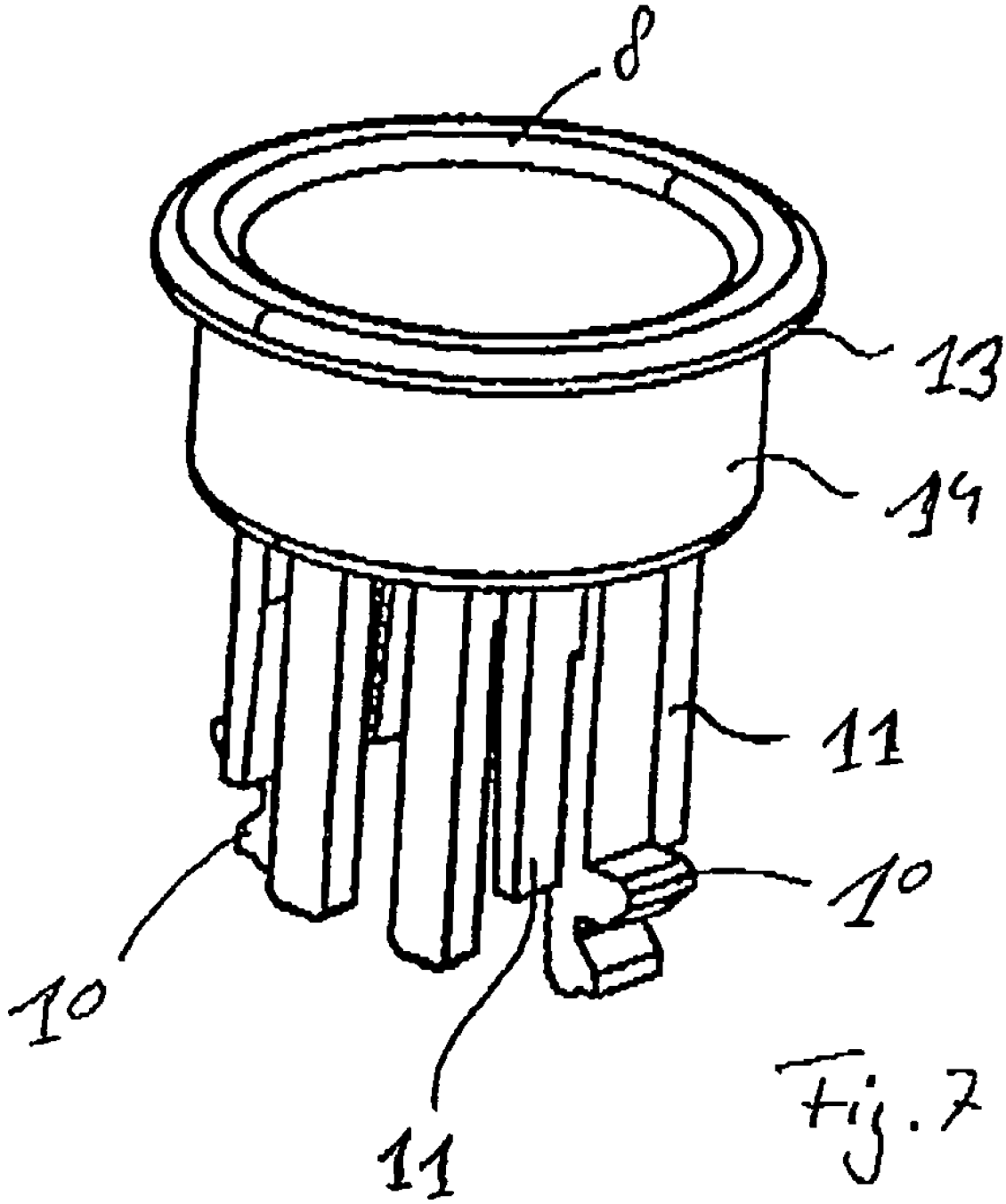
FIG. 7 shows a secondary interlock in accordance with an embodiment of the present invention.

As is apparent from FIG. 7, the secondary interlock 8 on its end which is the bottom end in the drawing may be provided with a conventional push button mechanism 10 which actually performs the safeguarding function of the primary interlock 9. Furthermore, there may be guide extensions 11 which run in the lengthwise direction and parallel to the push button mechanism 10 and which are guided in the corresponding guides 12 (see FIG. 8) in the housing 2. In its region which is the upper region in the plane of the drawings (FIG. 7) the secondary interlock 8 comprises a peripheral annular shoulder 13 which projects radially to the outside. Underneath the annular shoulder 13, a circular cylindrical peripheral sealing section 14 adjoins in the axial direction.

As is apparent from FIGS. 1 to 6, the housing 2 may be jacketed by a housing seal 15. The area of the housing seal 15 which is the top area in FIGS. 2 and 5 may be made as a secondary interlock seal 16 comprising a peripheral sealing bead 17 which projects radially to the inside. The sealing bead 17 of the secondary interlock seal 16 both in the half-catch position (FIG. 4 to FIG. 6) and in the full catch position (FIG. 1 to FIG. 3) radially ajoins the circular cylindrical sealing section 14 of the secondary interlock 8 with pretensioning, forming a seal. The outside diameter of the sealing section 14 of the secondary interlock 8 may be made larger than the inside diameter of the sealing bead 17 of the secondary interlock seal 16 in the unmounted state.

In the full catch position the bottom of the annular shoulder 13 rests axially on the sealing bead 17. The improves the sealing action in the full catch position. There may be a so-called trunk area 18 on the side of the connector opposite the secondary interlock seal 16. In the trunk area 18 there may be a peripheral outside seal 19 with a sealing bead 20 which points radially to the inside. Contact plugs may be fixed to form a seal on the trunk area 18 with an outside seal 19.

Figure 2:
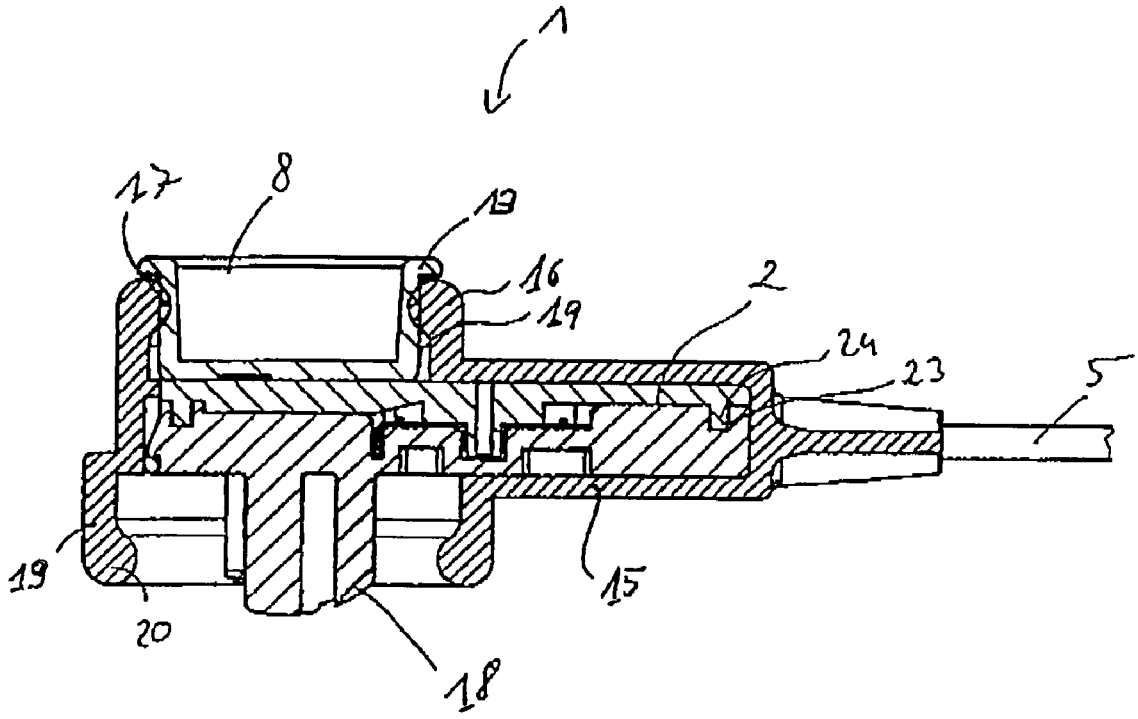
FIG. 2 shows a side elevational view in section of the connector as shown in FIG. 1.
Figure 5:
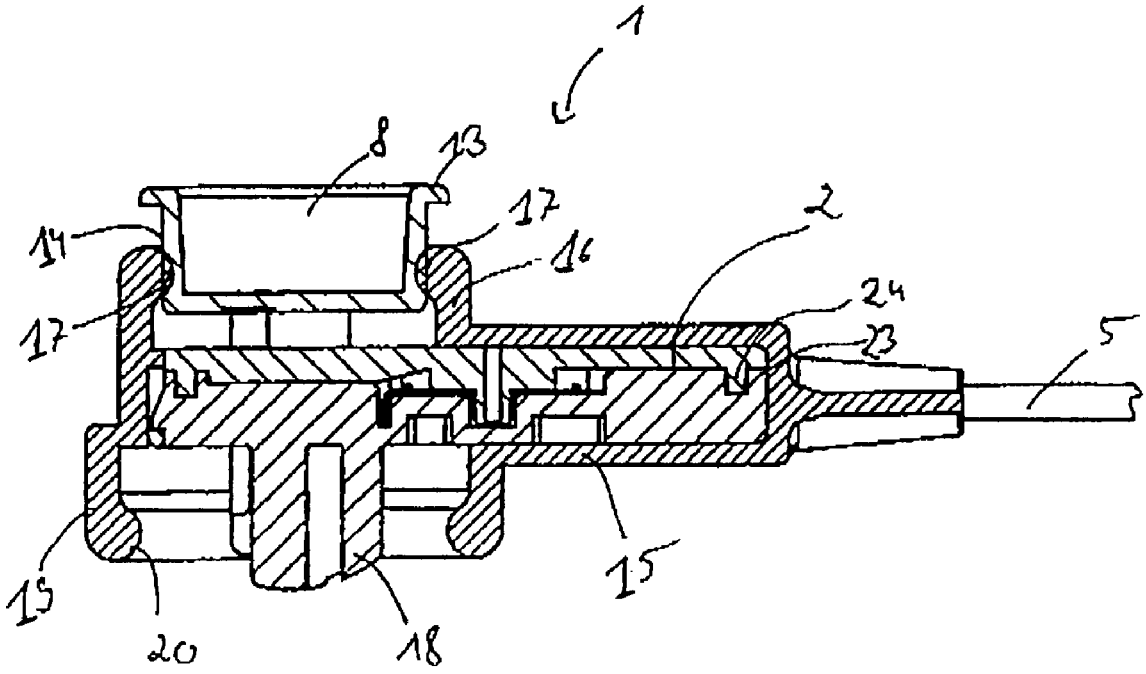
FIG. 5 shows a side elevational view in section of the connector as shown in FIG. 4.
Figure 6:
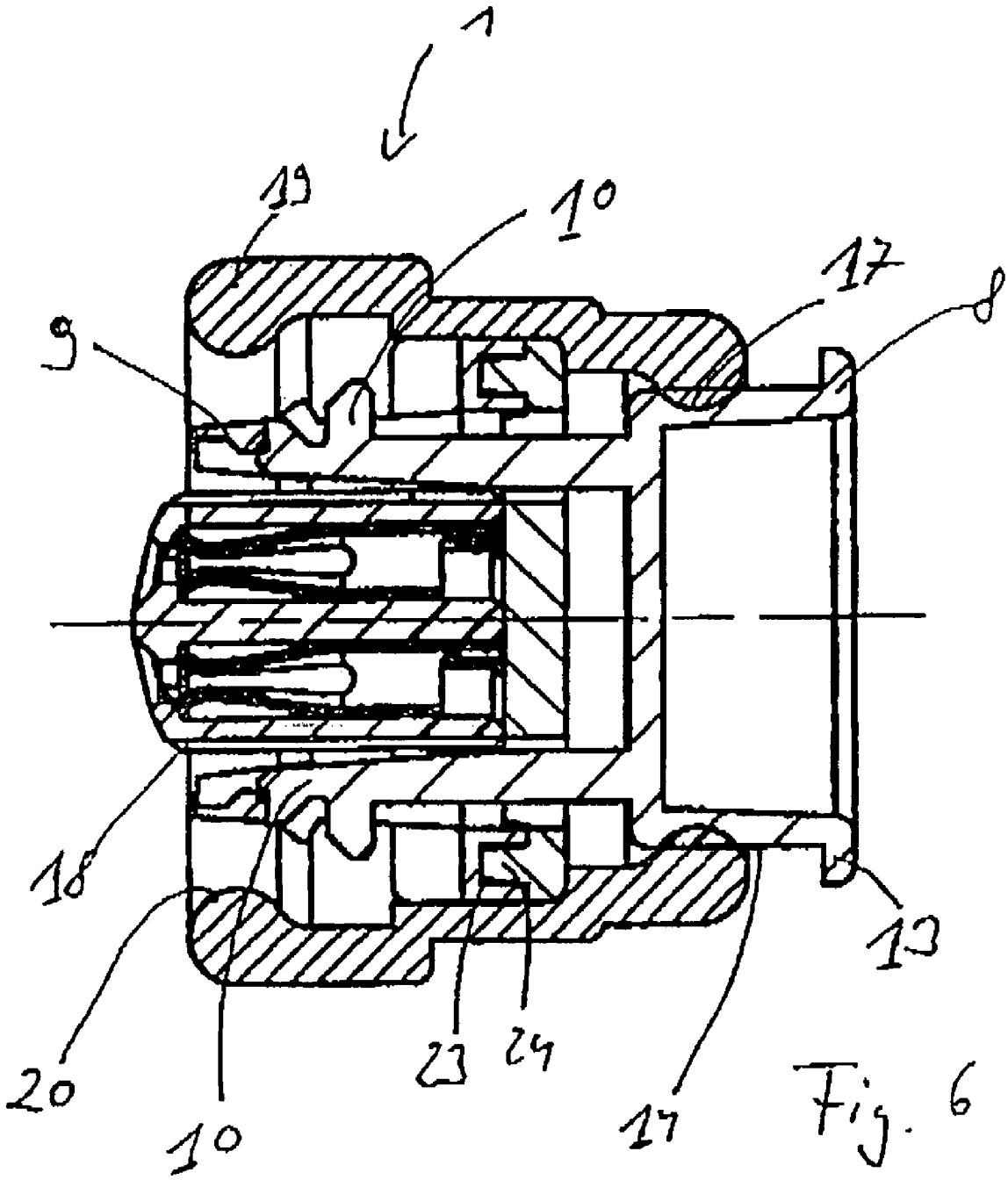
FIG. 6 shows an end elevational view in section of the connector as shown in FIG. 4.

As is apparent from FIGS. 2 and 5, the housing seal 15, the secondary interlock seal 16 and the outside seal 19 of the trunk area 18 may be made in one piece. In this exemplary embodiment, the seal material is polyurethane. But other suitable permanent elastic materials can also be used. The connector 1 (housing seal 15, secondary interlock seal 16, outside seal 19) may be sealed by extrusion coating of the housing 2 with the seal material. The secondary interlock 8 may be mounted after the extrusion coating process.

Figure 8:
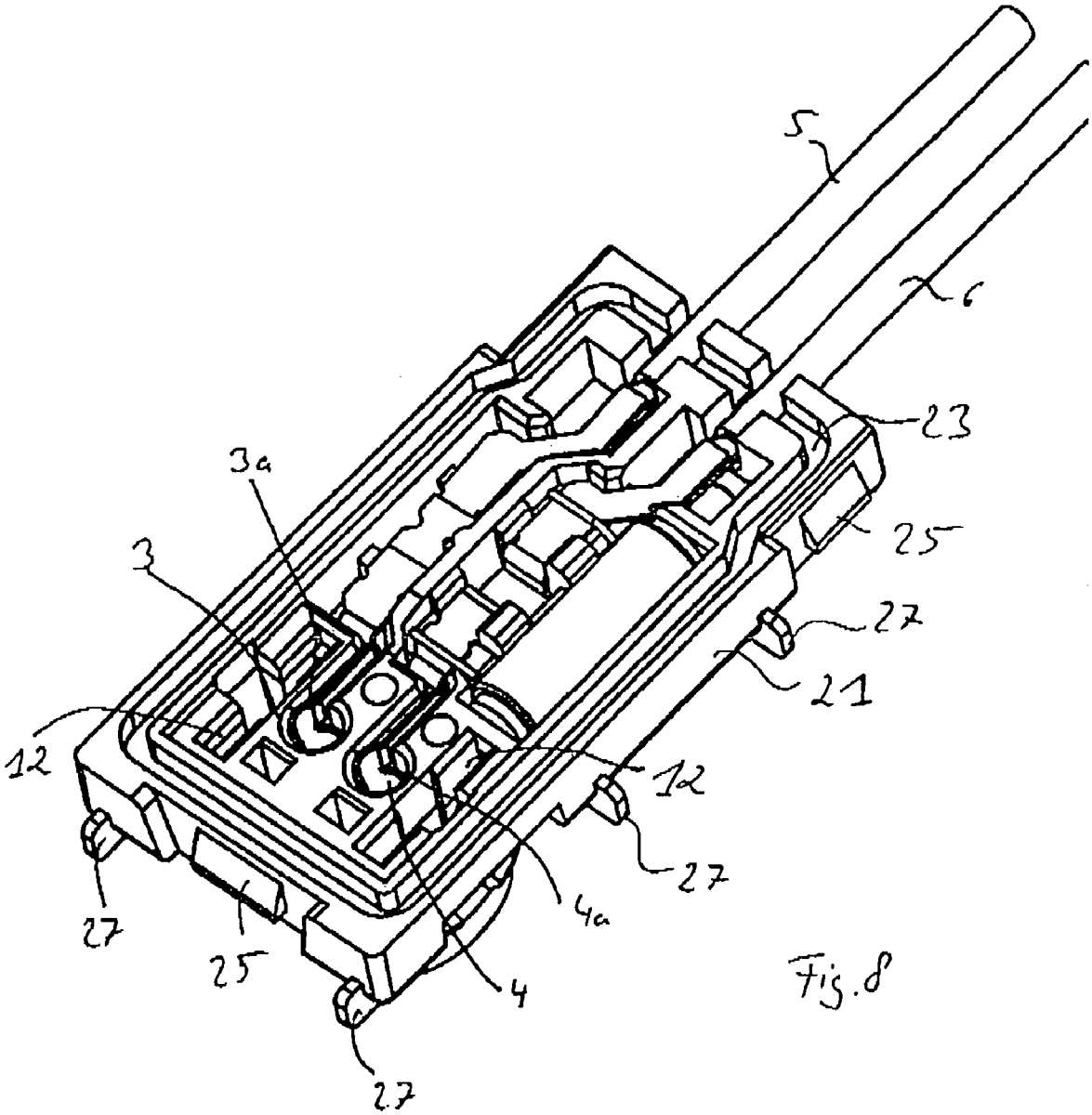
FIG. 8 shows a first housing part in accordance with an embodiment of the present invention.
Figure 5:
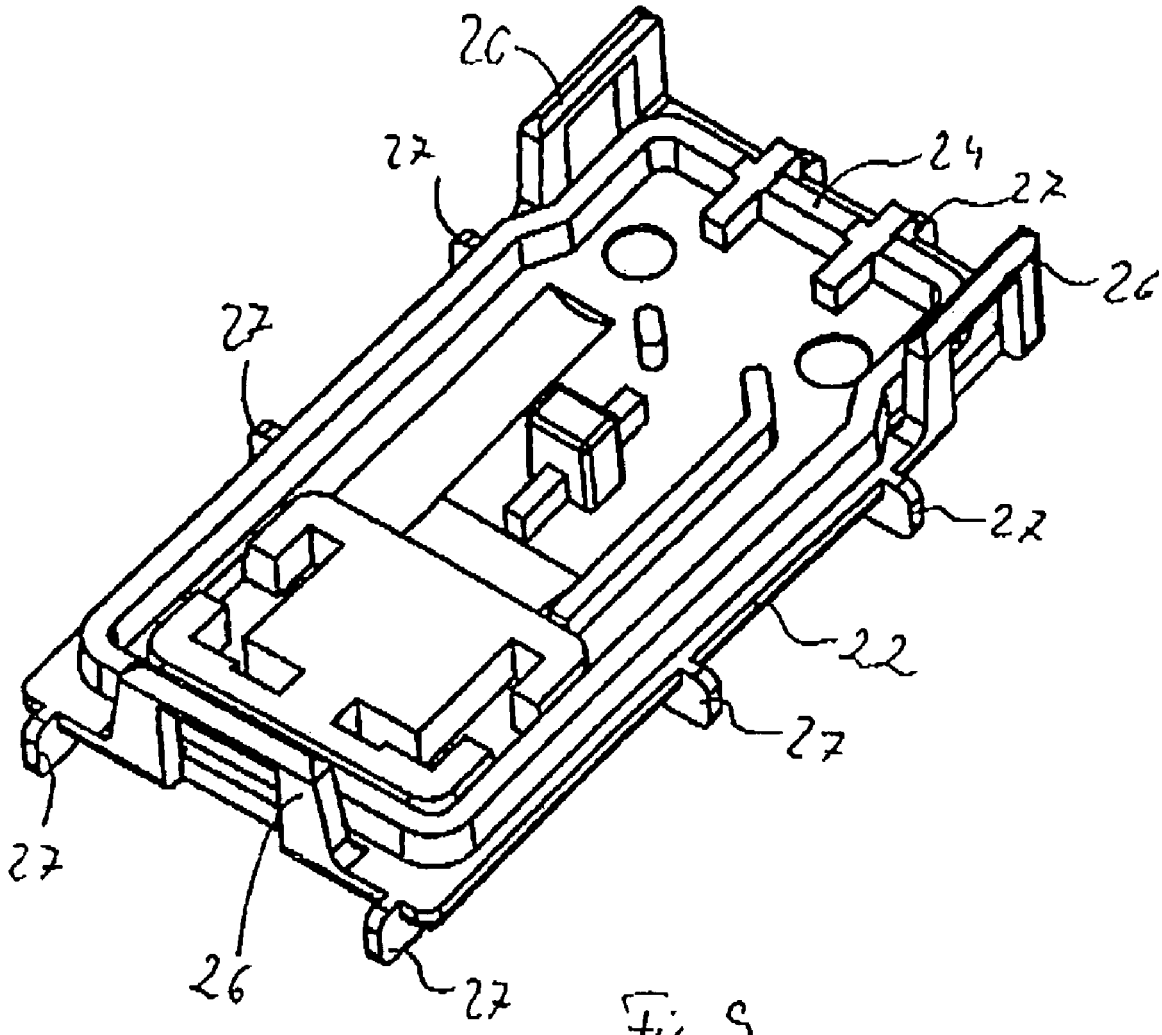

The housing 2 may comprise a lower tongue body 21 which is shown in FIG. 8 and an upper tongue body 22 which may be seated on it and which is shown in FIG. 9. A groove 23 which runs peripherally on the edge side may be placed in the lower tongue body 21. On the inside of the upper tongue body 22 which is shown in FIG. 9, a peripheral tongue 24 complementary in shape to the groove 23 may be molded. In the mounted state the tongue 24 preferably fits into the groove 23 and prevents the seal material from penetrating into the interior of the connector 1 in the extrusion coating process. To fix the lower to the upper tongue body 21, 22 there may be a catch mechanism comprising catch projections 25 and catch springs 26 which surround them. Furthermore, centering ribs 27 for the extrusion coating process with seal material may be molded on the periphery of the housing 2. Alternatively the tongue bodies 21, 22 may also be made overlapping one another.

Transfer of the secondary interlock 8 from its half-catch position into its full catch position works solely with igniters inserted. A short circuit bridge provided between the contacts 3*a* and 4*a* is unlocked in doing so. In this way the position of the seal can be electrically deduced. If the secondary interlock 8 is in its full catch position, the contact plug may be inserted and sealed to the outside as a result of the peripheral outside seal 19.

What is claimed is:

1. A connector, comprising of:

a plurality of receptacles located in a housing;

a primary interlock for engaging a contact plug pluggable into the receptacles;

a secondary interlock, moveable between a full catch position and a half-catch position with respect to the housing; and a peripheral seal for sealing the secondary interlock relative to the housing, wherein the secondary interlock being moveable relative to the seal while maintaining a seal from the half-catch position into the full catch position of the secondary interlock.

2. A connector as claimed in claim 1, wherein the secondary interlock has an axial stop with an annular shoulder for contact with the seal in the full catch position.

3. A connector as claimed in claim 1, further comprising a trunk area for holding the contact plug, and the trunk area including a peripheral seal for the contact plug.

4. A connector as claimed in claim 1, wherein the receptacles are connected via a short circuit bridge which is made such that the short circuit bridge is separated by shifting the secondary interlock into the full catch position.

5. A connector as claimed in claim 1, wherein the secondary interlock has an external approximately circular cylindrical, peripheral sealing section.

6. A connector as claimed in claim 5, wherein the seal has a radial sealing bead which runs along a periphery adjoining a sealing section.

7. A connector as claimed in claim 5, wherein an area of the secondary interlock surrounded by the sealing section is sealed.

8. A connector as claimed in claim 1, wherein the seal is made integrally with the housing.

9. A connector as claimed in claim 8, wherein the seal and the housing are produced by extrusion coating of the connector with a permanent elastic material.

10. A connector as claimed in claim 1, wherein the housing has first and second releasable lockable components.

11. A connector as claimed in claim 10, wherein the first and second lockable components are lockable by tongue and groove.

12. A connector, comprising of:

a housing having a plurality of receptacles;

a primary interlocking means for a contact plug pluggable with the receptacles;

a secondary interlocking means movable between a full catch position and a half-catch position with respect to the housing; and a peripheral sealing means for sealing the secondary interlocking means with respect to the housing from the half-catch position to the full catch position.

13. A connector as claimed in claim 12, wherein the secondary interlock means has a substantially circular peripheral sealing section that engages a radial sealing bead as the sealing means.

14. A connector as claimed in claim 12, wherein the secondary interlock means has an axial stop including an annular shoulder for contacting the sealing means when in the full catch position.

15. A connector as claimed in claim 12, wherein the sealing means is formed integrally with the housing.

16. A connector as claimed in claim 12, further comprising a trunk area for holding the contact plug, the trunk area including a peripheral seal for the contact plug.

* * * * *